United States Patent [19]

Gates

[11] Patent Number: 4,943,075

[45] Date of Patent: Jul. 24, 1990

[54] PAIR OF WHEELED SKATE-SKIS WITH BRAKES USABLE ON MOST TERRAINS

[76] Inventor: Patrick G. Gates, 9716 122nd St. East, Puyallup, Wash. 98373

[21] Appl. No.: 395,881

[22] Filed: Aug. 18, 1989

[51] Int. Cl.[5] ..... A63C 17/14

[52] U.S. Cl. ..... 280/842; 280/11.2; 280/11.23; 280/11.3; 188/72.9

[58] Field of Search ..... 280/11.12, 842, 843, 280/11.19, 11.2, 11.23, 11.25, 11.27, 11.3, 11.31; 188/70 R, 71.1, 72.1, 72.3, 72.9, 74, 75, 76, 325, 328

[56] References Cited

U.S. PATENT DOCUMENTS

| | | | |
|---|---|---|---|
| 3,365,208 | 1/1968 | Blanchard | 280/11.23 |
| 3,389,922 | 6/1968 | Eastin | 280/11.23 |
| 3,749,413 | 7/1973 | Nicolson | 280/11.2 |
| 3,767,220 | 10/1973 | Peterson | 280/11.2 |
| 3,829,111 | 8/1974 | Nicholls | 280/11.3 |
| 3,876,217 | 4/1975 | Copier | 280/11.23 |
| 3,884,486 | 5/1975 | Wilje | 280/11.2 |
| 3,900,203 | 8/1975 | Kukulowicz | 280/11.2 |
| 4,033,596 | 7/1977 | Andorsen et al. | 280/11.2 |
| 4,050,705 | 9/1977 | Kreis | 280/11.2 |
| 4,072,317 | 2/1978 | Pommerening | 280/11.23 |
| 4,076,266 | 2/1978 | Krausz | 280/11.2 |
| 4,107,856 | 8/1978 | Bourque | 36/115 |
| 4,183,546 | 1/1980 | Heilig | 280/11.2 |
| 4,363,492 | 12/1982 | Eriksson | 280/11.23 |
| 4,418,929 | 12/1983 | Gray | 280/11.23 |
| 4,718,181 | 1/1988 | Olivieri | 36/119 |
| 4,805,936 | 2/1989 | Krantz | 280/11.2 |

*Primary Examiner*—Charles A. Marmor
*Assistant Examiner*—Richard Camby
*Attorney, Agent, or Firm*—Roy E. Mattern, Jr.

[57] ABSTRACT

A pair of wheeled skate-skis, equipped with hand moved operating control cables to initiate bicycle wheel type caliper operated frictional braking pads contacting wheel rim sides to slow down and/or to stop, are provided for use by a sportsperson who enjoys skating-skiing on the level, going uphill, and/or coasting downhill. To further improve the sportsperson's control of his or her overall movement, while on these wheeled skate-skis, his or her sport shoes, are conveniently, removably, and securely, positioned on these wheeled skate-skis by wraparound binding portions, which during skating and skiing movements are held firmly in place by using "Velcro" or "Dual Lock" fasteners or like functional fasteners. The feet of the sportsperson are respectively supported on channel cross sectional shaped bodies, with the exterior of each web of each channel being upright and the flanges of each channel depending to position portions of the "Velcro" or "Dual Lock" fasteners and to receive the transverse fore and aft shafts, about which the fore and aft wheels rotate. Each wheel has an air inflated tube and tire, one and three-fourths inches wide and seven inches in diameter. Each channel has cutouts to respectively accommodate the wheels, while still extending around the wheels, thereby sustaining sufficient strength in the overall strength of the channel, serving as the supporting platform, housing, chassis, and/or body. Finger operated braking levers, used in moving the brake operational control cables are fitted to adjacently spaced upstanding rods that are received in the respective palms of the sportsperson's hands. "Velcro" wraparound straps securable to these depending palm receiving rods are looped about the sportsperson's hands or wrists during downhill travel, when braking actions are being undertaken, or operationally about belts or belt loops, during climbing and/or level travel.

5 Claims, 5 Drawing Sheets

PAIR OF WHEELED SKATE-SKIS WITH BRAKES USABLE ON MOST TERRAINS

BACKGROUND

For many years skate and ski, and skate-ski sport products that are equipped with wheels have been available and/or illustrated and described in patents For example:

In 1968 Duane E. Blanchard in his U.S. Pat. No. 3,365,208 presented his roller skis having an elongated base member including spaced apart braces, together supporting wheels fore and aft and positioning and securing a sportsperson's feet in his or her boots. No braking components were used.

Also in 1968, Edward H. Eastin, in his U.S. Pat. No. 3,389,922, described and illustrated his amusement and sporting device having two frames, each supporting a respective foot of the sportsperson, and fore and aft wheels. The wheels were mounted on axles which could be inclined to obtain steering control. No braking components were used.

In 1973, John G.Nicolson, in his U.S. Pat. No. 3,749,413 disclosed his wheeled skis for dry land cross-country style skiing. The frames of skis supported fore and aft wheels on respective axles. Pivotal toe harnesses received the boots and feet of the sportsperson. As a person's stride was completing a pivoted toe harness directed a pivot bar into braking contact with a front wheel, so the person could in effect push off from this wheeled ski when the brake was on. No other braking components were provided.

Also in 1973, Robert A. Peterson in his U.S. Pat. No. 3,767,220 presented his foot receiving two wheeled vehicle, with two such vehicles being used by a sportsperson to ski on dry land. The wheels were of comparatively large diameter and the foot supports were located well below the axles of the wheels. The dry land skier to slow down or to stop leaned back to position his or her leg supported brakes against the rear wheel to create the braking force.

In 1975, Henri Copier, in his U.S. Pat. No. 3,876,217, illustrated and described his twin-roller skates adjustable to a shoe. He provided a foot-rest base plate with front and rear mounted wheels. The front wheel was mounted for oscillation about an axis so it was effective in helping the sportsperson to turn. Also the front wheel during straight travel, if it was tilted would rub against braking pads. Both the turning and braking positions were created by the sportsperson's body movements, commencing with a lightening technique movement well known to persons who snow ski.

Also in 1965 Sven Oscar Wilje in his U.S. Pat. No. 3,884,486 disclosed his brake device for roller skis wherein helical compression springs provided between wheels and the frame prevented braking until the sportsperson moved his or her foot sideways against the action of the spring, to move braking components together.

In 1977, John P. Andorsen in his U.S. Pat. No. 4,033,596 illustrated and described his roller ski having leg operated braking means. The sportsperson would lean backwards to cause a braking force against the dual rear wheels.

Also in 1977 Phillip Kreis in his U.S. Pat. No. 4,050,705 disclosed his braking device for ski scooters.

A sportsperson using a ski stick would depress a lever to create a braking force.

In 1982, Arne Eriksson in his U.S. Pat. No. 4,363,492 illustrated and disclosed his roller ski for training for long distance skiing events. The wheels had pneumatic rubber tires. There was no braking equipment.

In respect to bindings to receive the feet of sportspersons using roller skates, in 1974, Bryan Frederick Nicholls in his U.S. Pat. No. 3,829,111 illustrated and described his roller skates having separate ankle and toe straps each attached to a roller carrying chassis. Each strap was made of flexible synthetic resin material.

In 1978, Rudiger Pommerening in his U.S. Pat. No. 4,072,317 disclosed his roller skate having an ankle bracing support and both toe and ankle straps.

In 1988, Oiviero Olivieri in his U.S. Pat. No. 4,718,181 illustrated and described his binding device to secure a sportsperson's foot, within a boot structure, to a bearing structure of a sporting implement.

In 1978, Rene Bourque in his U.S. Pat. No. 4,107,856 disclosed his fast closing athletic boot using a molding technique in respect to providing a boot for an ice skate.

In 1983, William J. Gray in his U.S. Pat. No. 4,418,929 illustrated his single roller skate having a front foot stabilizer portion and two ankle stabilizer portions.

These various patents indicate how many persons have provided sportspersons with equipment for receiving their feet while they travel over various terrains using skating and/or skiing motions. However, when a sportsperson desired to roll over terrain having some irregularities and varying in slope, requiring both climbing and coasting downhill, equipment was not available, which the sportsperson could use safely going downhill, if the creation of reliable braking forces was necessary, while he or she remained in safe body positions to keep his or her excellent balance.

SUMMARY

There are sportspersons who enjoy one or more of the sports of snow skiing or board skiing in the winter, water skiing or surf boarding in the summer, ice skating in the winter, roller skating or skate boarding in the summer, who, with other persons, also would like to travel more conveniently and safely in warm weather on walks, roads, lawns, and some other selected terrains, involving both climbing and coasting downhill. This all terrain pair of wheeled skate-skis with hand operated brake controls and brakes provides these sportspersons with such athletic equipment.

They select and wear a favorite pair of sport shoes, then step respectively on the channel serving as the supporting platform, housing, chassis, and/or body and firmly position their feet, in their shoes, and portions of their legs, on and over the channel by using wrap-around binding portions, which during skating and skiing movements are hold firmly in place by using "Velcro" or "Dual Lock" fasteners, or like functioning fasteners.

Wheels with pneumatic tires large enough in diameter at seven inches, and wide enough at one and three quarters of an inch to roll over small irregularities, and yet small enough to keep the sportsperson's feet comparatively close to ground level, function with the other components, to provide the safe travel motion sought by the sportsperson.

The wheelbase is selectable in different embodiments depending on the size and weight of the sportsperson.

Each embodiment provides the respective sportsperson with a feeling or experience of ski length stability and tracking, not afforded by shoe-length skates, yet the overall length is short enough to gain the advantages of a skating felling or experience.

At all times when the sportsperson desires to slow down and/or stop, in each of his or her hands are levers to be moved, in turn moving brake operational control cables that extend down to the rear of each channel. There the control cables are connected to the pivotal linkage of caliper operated frictional braking pads, which are moved against spring return forces to contact the wheel rim sides to apply the braking forces.

The pair of wheeled skate-skis, with hand operated brakes, usable on most terrains, is illustrated in the drawings, wherein:

FIG. 1 is a perspective view of a sportsperson on the wheeled skate-skis as he or she is commencing coasting downgrade over terrain, with his or her hands holding the braking control levers, which will be hand operated, when necessary, to move the control cables, to in turn move the calipered bicycle type brakes into contact with the respective rear wheels;

FIG. 2 is a perspective view of the left wheeled skateski, as viewed from the left side thereof, showing, in more detail, the left foot binding as it is arranged to support the left foot and left shoe, not shown, of a sportsperson, and illustrating, in more detail, the overall braking assembly on the left wheeled skate-ski, with portions of the length of the control cable, not shown, and showing the pneumatic tube-tire wheels, and also showing the "Velcro" or "Dual Lock" or like fasteners;

Figure 7:
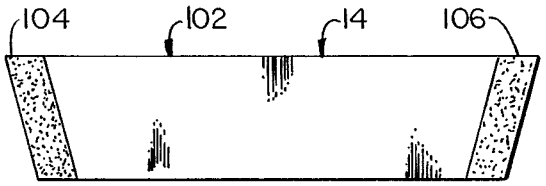
Figure 6:
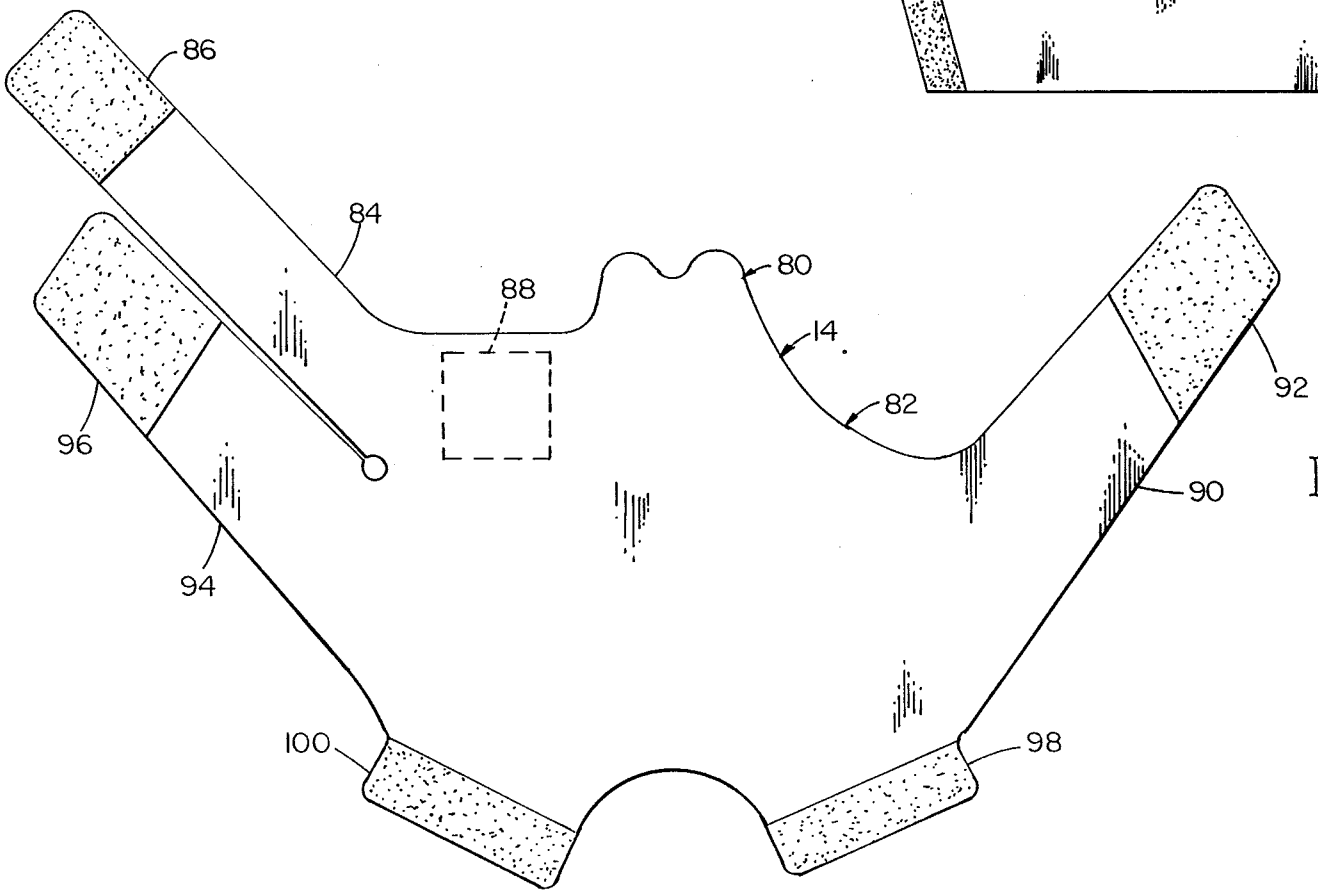

FIG. 6 is a planar view of the main or principal portion of the left foot binding, as this principal portion appears following manufacture, inclusive of "Velcro" or "Dual Lock" or like fasteners, and as it appears before being installed about the left foot of a sportsperson, who has already placed his or her left foot into a selected sportsshoe; and FIG. 7 is a planar view of the toe portion of the left foot binding, as it appears following manufacture, inclusive of the "Velcro" or "Dual Lock" or like fasteners, and as it appears before using this toe portion to bind the sports shoe covered toes of the sportsperson's foot, thereby completing the binding support of the sportsperson's left foot; the binding support of a sportsperson's right foot being undertaken, in respect to the overall mirror image, of how his or her left foot has been supported in the respective left foot binding.

DESCRIPTION OF THE PREFERRED EMBODIMENT

Introduction Regarding Using These Wheeled Skate-Skis

Figure 1:
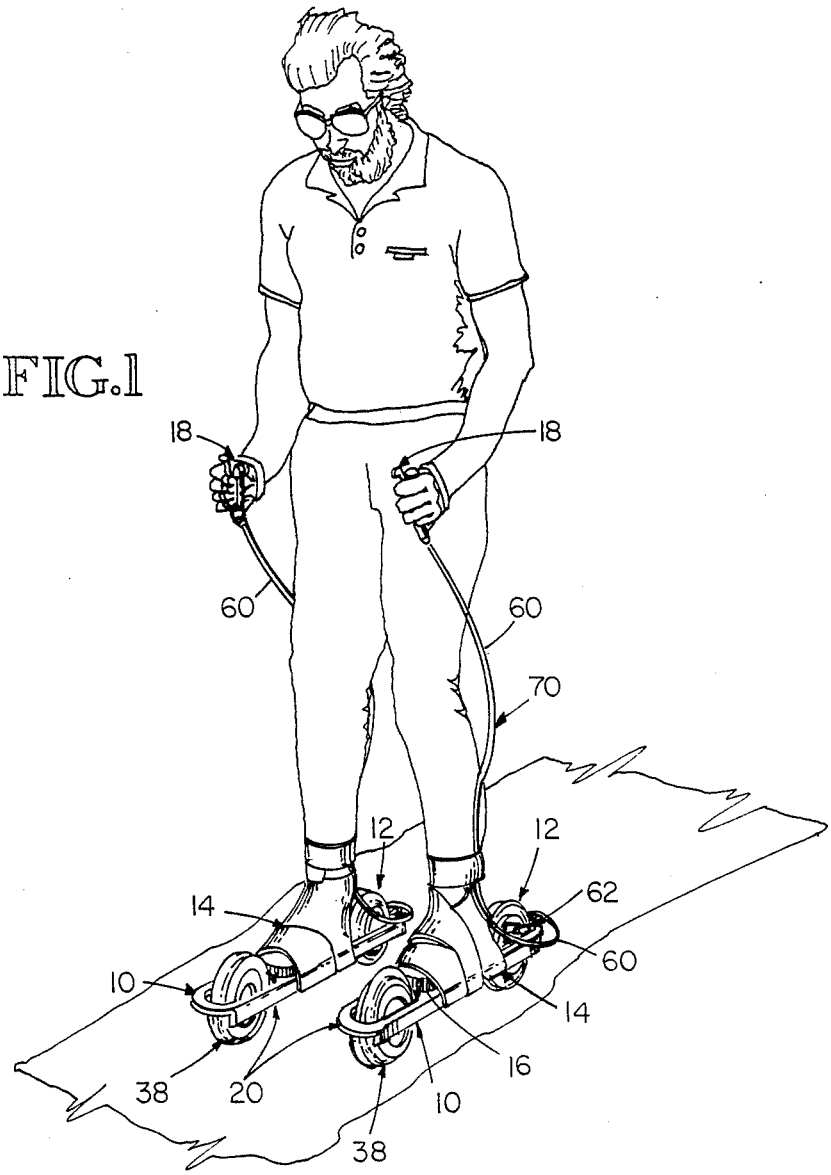

The preferred embodiment of the pair of wheeled skate-skis 10 with brakes 12 usable on most terrains is illustrated in the drawings. In FIG. 1, a sportsperson is shown as he or she is ready to go, having firmly positioned and supported his or her feet, with athletic shoes 16 on, to these wheeled skate-skis 10 using the bindings 14. Then with the hand controls 18 for the brakes 12 conveniently positioned, he or she is ready to get underway.

As illustrated the sportsperson is just commencing to coast down a grade of terrain. When the speed increases he or she will be changing their body positions by lowering their center of gravity and leaning forward. At all times the hand controls 18 for the brakes 12 are conveniently held and ready to operate to apply braking forces to one or to both wheeled skate-skis 10 to slow down and/or to stop. During braking operations, because of the convenience of the hand controls 18 for braking, the sportsperson remains in the most stable selected body positions for safely keeping his or her balance.

When coasting is completed, and skating motions are undertaken by the sportsperson to gain speed on a level surface or to climb a hill, the overall arrangement of all the components of these wheeled skate-skis 10 makes such skating motions very easy to perform. If such level and uphill maneuvers are to continue for a while, the sportsperson has the option to support the hand controls 18 for the brakes 12 on his or her belt, belt loop or other garment location.

The wheeled skate-skis 10 are provided in sizes with respect to both the overall length and the bindings 14. Each binding size because of the use of "Velcro" or "Dual Lock ", or like fasteners, is well fitted with respect to a range of foot sizes. Likewise, each overall length of a wheeled skate-ski 10 is well fitted in respect to a range of foot sizes and weights of sportspersons.

The Channel Serving as the Supporting Platform, Housing, Chassis and/or Body Throughout the designing and manufacture of these wheeled skate-skis 10, the objective was to utilize the best components selectable from readily available products, materials, and fasteners. To provide what may be called the supporting platform, housing, chassis and/or body 20, a fiberglass commercially available structural channel 22, obtained in long pieces, is cut to selected embodiment sizes of overall lengths. As particularly shown in FIGS. 1 and 2, the exterior surface 24 of the web 26 of this channel 22 serves as the supporting surface to receive the sportsperson's foot, within an athletic shoe 16. The left and right depending flanges 28, 30, of this channel 22, serve as strength members; to receive a strip 32 of "Velcro", or "Dual Lock" or like fastener 32; to receive components of the brakes 12; and to receive transverse axles 34 with bearings, not shown. The web 26 has cutouts 36 to accommodate the wheels 38, mounted on the axles 34 and secured by fasteners 40. The web 26 has extended portions 42 around the wheels 38 to continue the strength of the supporting platform 20 and to provide bumpers 42. One of these extensions 42, preferably the aft or rear one, supports components of the brakes 12, and provides a hole 44, to receive a fastener 46 securing the components of the brakes 12 to the supporting platform, housing, chassis, or body 10.

The Braking Assembly Inclusive of Hand Operated Controls

Continuing with the selection of available products, essentially all of the braking assembly 50 to provide the brakes 12, as illustrated in FIGS. 1 through 5, is obtained from commercially available components. The selected type of brakes 12 are bicycle wheel type caliper operated frictional braking pads 52, which contact the rims 54 of the wheels 38. The two pivoting calipers 56 and 58 are pivotally mounted on the rear bumper 42 using the hole 44 and fastener 46. As particularly shown in FIG. 3, the upper positioned caliper 56 is connected by fastener 59, at one end to the housing 60 of the control cable 62, and at the other end, by fastener 64, to a braking pad 52. The lower positioned caliper 58 is connected at one end, by fastener 66, to the control cable 62, and at the other end, by fastener 68, to the other braking pad 52. Return springs 69 serve to move the braking pads 52 via the calipers 56 and 58 clear of the rims 54 when the braking forces are no longer needed.

The subassembly 70 of control cable 62 and cable housing 60 is extended to reach the waist heights of respective sportspersons, as illustrated in FIG. 1. At this upper end the brake lever 72 and the connector base 74 thereof is secured to rod 76, which is sized to fit in the palm of the hand of the sportsperson. Also the connector base 74 is secured to the housing 60 of the control cable 62 which, in turn, is connected to the brake lever 72. A strip 78 of "Velcro" or "Dual Lock" or like fastener is secured in part to the rod 76, and the free portions of this strip 78 are used to form a loop 78 which surrounds the hand or wrist of the sportsperson, when he or she is intending to use the brakes 12. When the sportsperson does not intend, for a period of time, to use the brakes 12, then he or she uses the strip 78 to form a loop 78 about his or her belt, belt loop, or other garment portion.

The operation of this braking assembly 50 is always conveniently undertaken whenever braking forces must be created. The sportsperson, via the manipulation of his or her fingers initiates and controls these braking forces. The sportsperson does not have to reposition his or her body solely to create braking forces. Instead he or she remains in the best selected body position in keeping with the speed of travel and the surface of travel.

Figure 2:
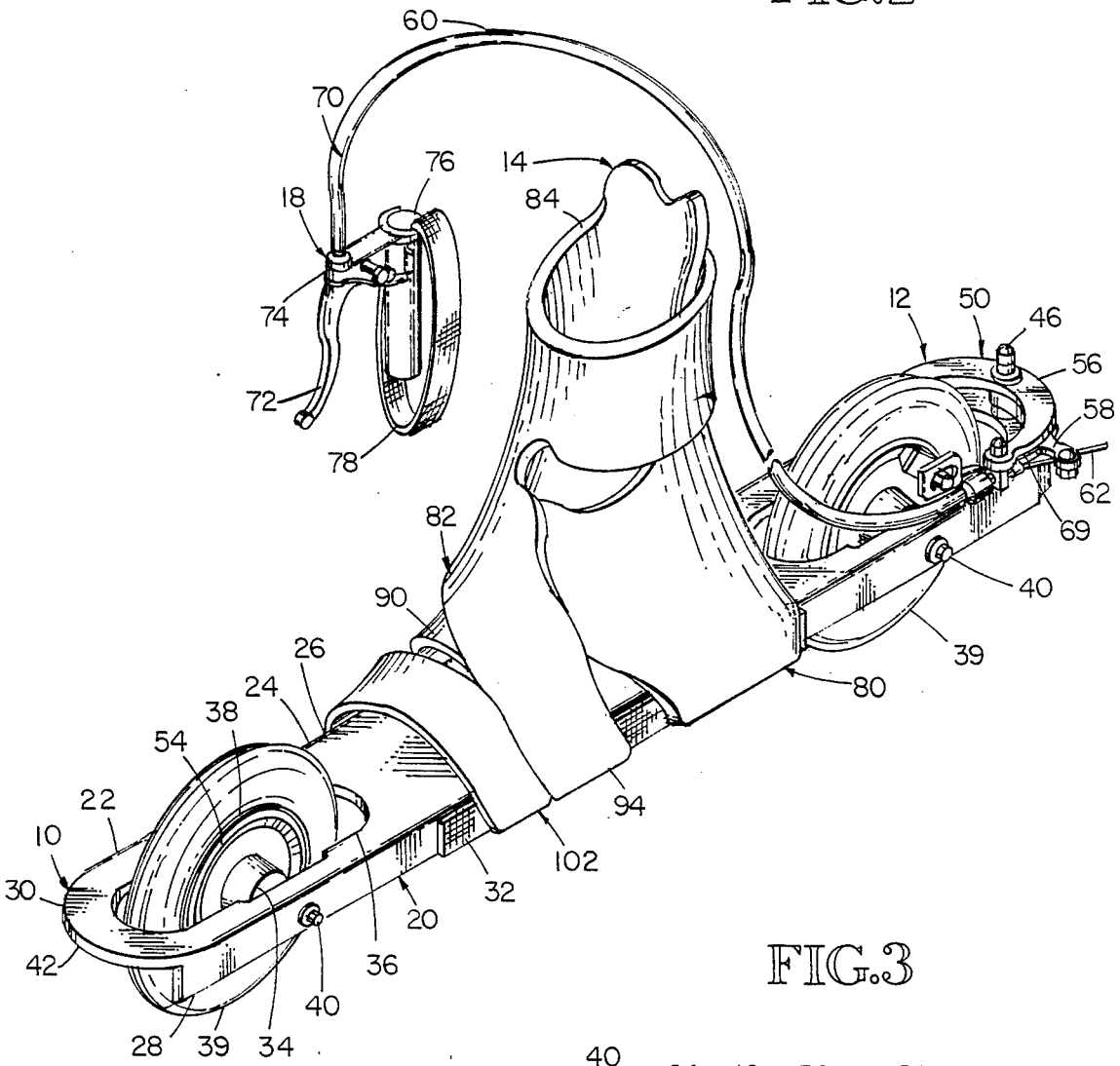
Figure 3:
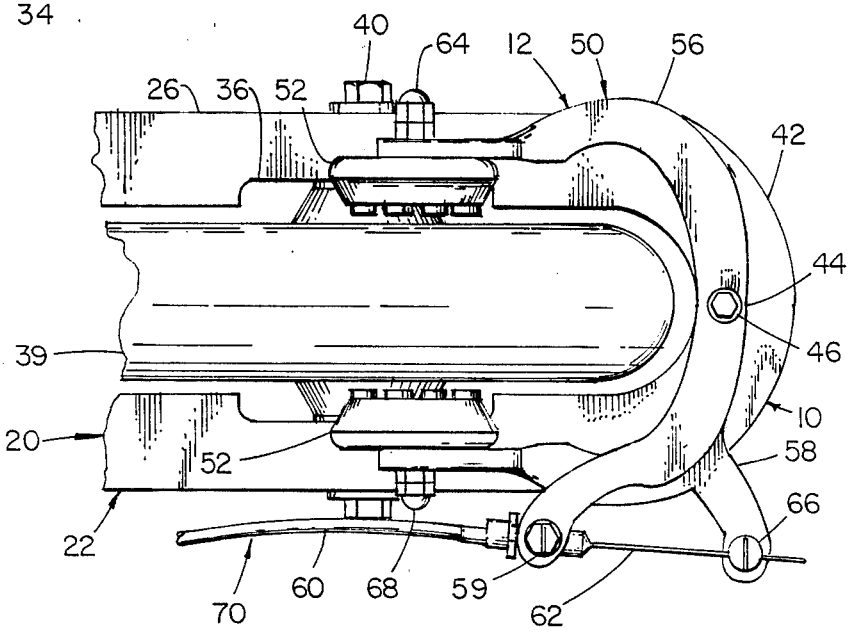
FIG. 3 is a partial top view of the left wheeled skateski to indicate the installed bicycle type calipered brake and portions of the control cable.
Figure 4:
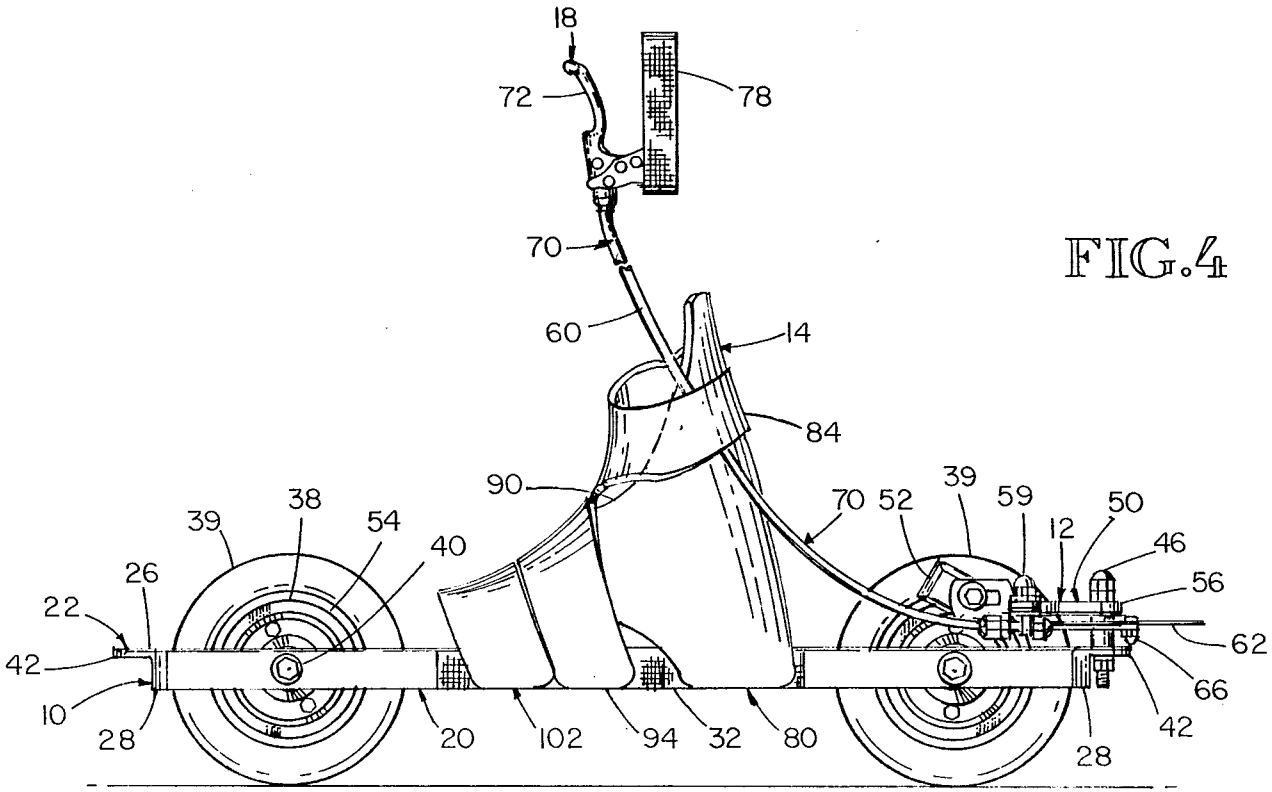
FIG. 4 is a left side view of the left wheeled skate-ski indicating how the control cable shown in part, is connected between the hand operated braking lever, and the bicycle type calipered brake, and also showing how the control cable may be passed inside the leg encircling strip of the left foot binding.
Figure 5:
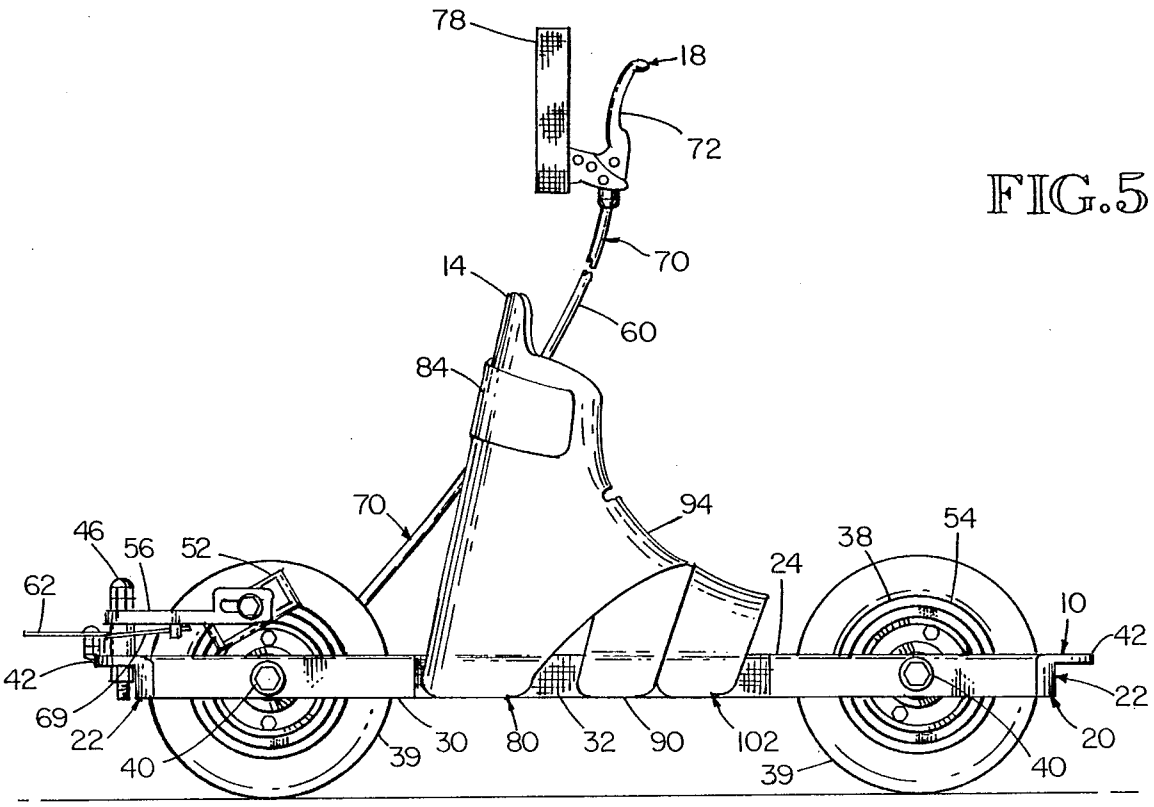
FIG. 5 is a right side view of the left wheeled skateski to indicate the different appearing arrangement of the straps of the left foot binding on this right side thereof.

Adjustable, Removable Bindings to Hold a Sportsperson's Foot in Athletic Shoe to Wheeled Skate-Ski The respective bindings 14 shown in FIG. 1 are holding and supporting the sportsperson's foot in an athletic shoe 16 with respect to each wheeled skate-ski 10. In FIGS. 2, 4, and 5, respective bindings 14 are shown as they are secured in place with respect to a wheeled skate-ski 10. As illustrated in FIGS. 6 and 7, in reference to a left foot binding 14, the removed binding 14 assumes a planar configuration when placed on a flat surface. Preferably a "P.V.C" vinyl material is used and "Velcro" or "Dual Lock" or like fasteners are specifically placed at the needed designated locations.

In FIG. 6, an inside plan view is shown of the principal ankle-leg supporting portion 80 of the left foot binding 82. The right foot binding is the mirror image of the left foot binding and it is not illustrated. Other portions of this principal ankle-leg supporting portion 80 are:

the wrap around leg strap 84 with its interconnecting fastener portions 86, 88;

the outside to inside strap portion 90 having its fastener portion 92, which is secured to the fastener strip 32 on the inside depending flange 30, which on the left wheel skate-ski 10, is the right depending flange 30;

the inside to outside strap portion 94 having its fastener portion 96, which is secured to the fastener strip 32 on the outside depending flange 28, which on the left wheel skate-ski 10, is the left depending flange 28; and then at the bottom of this principal portion 80 are respective left and right side fasteners 98, 100, which are secured to the respective strips 32 on the respective left and right depending flanges 28 and 30, of the channel 22, when this principal ankle-leg supporting portion 80 of the binding 14 is used to position and to support the sportsperson's foot in the athletic shoe 16 on the wheel skate-ski 10.

The other portion of the bindings 14 is the toe portion 102, shown in FIG. 7, in its planar position with fasteners 104 and 106, before being installed over the toe of an athletic shoe 16 with the foot of a sportsperson inside, as shown in FIG. 1. The fasteners 104 and 106 are interconnected with respective strips 32 of fasteners on respective left and right depending flanges 28, 30.

These bindings 14 are strong, durable, easily manipulated, and securely positioned providing excellent support of the foot and leg of the sportsperson. When stored they are arranged in a planar position, one on top of the other.

Comments Regarding Sizes. Materials, Products and Uses

Regarding the brakes, a brake assembly designated as a "BMX" brake type has been used. These brakes have a brake-on-button to keep the brakes on when a person is using the wheel skate-skis to walk, and especially when he or she walks uphill.

The bearings used in the wheels are 5/16" inside diameter. The tube in the tire is inflatable up to 60 p.s.i. and the pressure is reduced at times when going downhill to help in increasing the drag to reduce the speed. The preferable tire size is 7" in diameter and $1\frac{3}{4}$" wide.

The channel is preferably 4" wide with $1\frac{1}{8}$" depending flanges. The material of the channel is preferably fiberglass material, which is $\frac{1}{4}$" thick.

The control cable lengths are selected preferably in respect to waist heights of the sportsperson. There are times, when the lengths will be different. For example when being pulled by a large kite, a sportsperson has extended the control cable lengths placing the brake control levers in the locale with the hand held and operated kite controls.

Whatever the sizes, materials, products and uses selected, the resulting wheel skate-skis 10 provide the sportspersons with greater opportunities to enjoy this sport more thoroughly and with greater safety.

I claim:

1. A pair of wheeled skate-skis with hand operated brakes for use on most terrains, each of the wheeled skate-skis, comprising:

(a) a channel frame having a web and depending platform to receive a sportspersons foot already fitted into a selected sport shoe, and the outside surfaces of the depending flanges equipped with an adhered strip of one component of a "Velcro" or "Dual Lock" or like fastener, and having wheel receiving cutouts both fore and aft in the web to receive fore and aft wheels, and having transverse holes in the depending flanges by the cutouts to receive fore and aft transverse wheel axles, and having at one end of the web a vertical hole to receive a fastener used in mounting to the channel frame, a bicycle type spring return pivotal calipered braking unit;

(b) fore and aft wheels mounted on the fore and aft transverse wheel axles; and (c) said bicycle type spring return pivotal calipered braking unit mounted at the end of the web, having a fastener extending through said verticle hole in the channel frame for and operating handle thereof, extendable from the braking unit up to the waist height locales of sportspersons, who will be using this pair of wheeled skate-skis having hand operated brakes.

2. A pair of wheeled skate-skis as claimed in claim 1, having in addition, a multiple piece binding made of plastic material, which is initially planar, having a principal ankle-leg supporting portion, and a toe supporting portion, each of these portions having "Velcro" or "Dual Lock" or like fasteners, portions of which are interconnected with the "Velcro" or "Dual Lock" or like fasteners adhered to the depending flanges of the channel frame.

3. A pair of wheeled skate-skis, as claimed in claim 2, wherein the principal ankle-leg supporting portion integrally provides:

an ankle and leg segment, having a wrap around leg strap having in turn "Velcro" or "Dual Lock" or like fasteners;

an outside to inside instep strap with like fasteners; and an inside to outside overlaying instep strap with like fasteners.

4. A pair of wheeled skate-skis, as claimed in claims 1, 2, or 3, wherein the operating handle of the control cable of the bicycle type spring return pivotal calipered braking unit is a subassembly of a rod to be held in the palm of the hand of the sportsperson, a lever pivotally mounted to the rod to be pivoted relative to the rod, the lever in turn secured to the control cable for movement of the control cable to apply the brakes, and a "Velcro" or "Dual Lock" or like strap fastener of selectable effective length secured in part to the rod and adapted to be looped about the hand or wrist of the sportsperson, or alternately at selected operational times looped about the belt or a belt loop of a garment worn by a sportsperson.

5. A pair of wheeled skate-skis, as claimed in claims 1, 2, or 3, wherein the fore and aft wheels are pneumatic wheels which are operational at different selected pressures and sized to pass over irregularities of terrain surfaces.

* * * * *